US011186345B1

(12) United States Patent
Svendsen

(10) Patent No.: US 11,186,345 B1
(45) Date of Patent: Nov. 30, 2021

(54) MARINE VESSEL DOOR SYSTEM

(71) Applicant: Joel Svendsen, Miami Lakes, FL (US)

(72) Inventor: Joel Svendsen, Miami Lakes, FL (US)

( * ) Notice: Subject to any disclaimer, the term of this patent is extended or adjusted under 35 U.S.C. 154(b) by 5 days.

(21) Appl. No.: 16/800,308

(22) Filed: Feb. 25, 2020

Related U.S. Application Data

(60) Provisional application No. 62/860,532, filed on Jun. 12, 2019, provisional application No. 62/805,193, filed on Feb. 13, 2019.

(51) Int. Cl.
*B63B 19/08* (2006.01)

(52) U.S. Cl.
CPC ..... *B63B 19/08* (2013.01)

(58) Field of Classification Search
CPC ..... B63B 19/08; E05D 15/101
See application file for complete search history.

(56) References Cited

U.S. PATENT DOCUMENTS 3,075,803 A * 1/1963 Wilfert ..... E05D 15/101 49/212
5,921,613 A * 7/1999 Breunig ..... E05D 15/101 296/155
9,199,703 B1 * 12/2015 Svendsen ..... B63B 29/00
9,389,011 B2 * 7/2016 Kim ..... E05D 15/0604

* cited by examiner

*Primary Examiner* — Stephen P Avila
(74) *Attorney, Agent, or Firm* — John Rizvi; John Rizvi, P.A.—The Patent Professor®

(57) ABSTRACT

A marine vessel door system implemented within or on a marine vessel gunwale, wherein the door can be easily opened to allow easy loading or unloading of passengers and cargo and closed in order to prevent passengers and cargo from entering or exiting the vessel. The marine vessel door system includes a door body and a door-moving mechanism which translates the door body frontward and rearward aligned to the marine vessel gunwale. The door-moving mechanism can include an articulated parallelogram attached to a fixed structure of the marine vessel and carrying the door body such that the door body translates forward and rearward jointly with a movable part of the articulated parallelogram.

16 Claims, 11 Drawing Sheets

MARINE VESSEL DOOR SYSTEM

CROSS-REFERENCE TO RELATED APPLICATION

This application claims the benefit of U.S. Provisional Patent Application Ser. No. 62/805,193, filed Feb. 13, 2019, which is incorporated herein in its entirety, and U.S. Provisional Patent Application Ser. No. 62/860,532, filed Jun. 12, 2019, which is incorporated herein in its entirety.

FIELD OF THE INVENTION

The present invention relates generally to marine vessels, and more particularly, to a marine vessel door system implemented within a marine vessel gunwale, wherein the door can be easily opened to allow easy loading or unloading of passengers and cargo and closed in order to prevent passengers and cargo from entering or exiting the vessel.

BACKGROUND OF THE INVENTION

Watercraft or marine vessels are water-borne vehicles including ships, boats, hovercraft and submarines. The design of watercraft are optimized among others for resource extraction, transportation of cargo or passengers.

Accessibility of passengers and cargo between a dock and a deck of a marine vessel is often dependent on the dimensions of a passageway or opening through the vessel gunwale, and more specifically, by a height of the opening and a width of the opening. The height of the opening is limited by the distance between decks. The width of the opening is limited by the horizontal distance across the opening. The opening is commonly subject to requirements such as being able to accommodate a width of a wheelchair bound individual. Although this width is generally acceptable, it is not accommodating all circumstances.

A vessel gunwale opening may often be opened and closed by a door provided in the vessel gunwale. In some cases, vessel gunwale doors are hinged or pivotable, which provides a simple and cost-effective construction. However, hinged doors are disadvantageous in that they require a clearance for opening. This limitation can introduce complications in the design requirements. Furthermore, hinged doors are pivotally cantilevered by hinges; this configuration induces an undesired load on the support column. In addition, hinged doors can be dangerous in certain weather or environmental conditions, such as high winds or excessively rough seas, as the door can become unlatched and swing freely, potentially causing damages or injures to nearby objects or persons.

Alternative solutions are known consisting in sliding vessel gunwale doors which are capable of translationally moving along the vessel gunwale, often between the exterior deck of the vessel and the cabin interior. In many instances, sliding gunwale doors are preferred over hinged or swinging doors because of space requirements and the negative aspects of a hinged door suddenly swinging in either direction due to rolling seas or adverse weather conditions.

Sliding doors known in the art are often translationally carried by, or supported on, a track or guiding profile. However, such a sliding mechanism may become easily deteriorated in atmospheric conditions such as those typically withstood by marine vessels. As known, marine air may be humid and contain relatively high amounts of salt, which accelerate rusting and general wear of surrounding objects.

Accordingly, there is an established need for an improved marine vessel gunwale door which solves at least one of the aforementioned problems. For example, a marine vessel gunwale door is desired which is easy and safe to use and yet durable over time.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is a marine vessel door system implemented within or on a marine vessel gunwale, the door system comprising:

a door body; and a door-moving mechanism configured to translate the door body frontward and rearward aligned with the marine vessel gunwale.

The present invention is directed toward a marine vessel door system implemented adjacent to a marine vessel gunwale, wherein the door can be easily opened to allow easy loading or unloading of passengers and cargo and closed in order to prevent passengers and cargo from entering or exiting the vessel. The marine vessel door system includes a door body and a door-moving mechanism configured to translate the door body frontward and rearward relative to the marine vessel gunwale.

In another aspect, the door-moving mechanism is embedded in and concealed by the door body.

In another aspect, the door body is a hollow door body.

In another aspect, the door body is at least partially made of a transparent material making the door-moving mechanism visible from outside the door body.

In another aspect, the door-moving mechanism is mounted to a fixed structure of the marine vessel, particularly to the deck.

In another aspect, the door-moving mechanism comprises an articulated parallelogram configured to articulate frontward and rearward carrying the door body, wherein the door body translates forward and rearward jointly with the articulated parallelogram.

In another aspect, the articulated parallelogram comprises a longish bottom support (rigid structure), a longish top support and two rods, wherein the ends of the bottom and top support and the two rods are connected to each other in a manner that the four connections are articulated.

In another aspect, the four articulated connections define an articulated parallelogram which allows the top support of the door-moving mechanism to translate frontward and rearward relative to the bottom support, and thus enables the door body to translate forward or rearward of the fixed structure and thus form an opening in the marine vessel gunwale.

In another aspect, at least one of the connections between the bottom and top support and the two rods is provided by holes and pins forming a hinge.

In another aspect, the articulated parallelogram is dimensioned in a manner that opposite angles of the parallelogram stay the same during a movement of the top support relative to the bottom support.

In another aspect, the bottom and top support are of the same length.

In another aspect, the rods are of the same length.

In another aspect, the rods are longer than the bottom and/or the top support.

In another aspect, the articulated parallelogram is dimensioned in a manner that the sum of all four angles of the parallelogram stays at 360° during a movement of the top support relative to the bottom support.

In another aspect, the articulated parallelogram is dimensioned in a manner that a sum of angles next to each other in the parallelogram stays at 180° during a movement of the top support relative to the bottom support.

In another aspect, at least one of the bottom and top support and the two rods comprise a stainless material, particularly stainless aluminum or a stainless alloy like stainless steel. The marine air and the marine water contain a large amount of salt, which corrodes materials made of a metal. This leads to a rusty surface of the metal. Stainless materials are protected from corrosion and rust.

In another aspect, the door body is of the same material as the gunwale.

In another aspect, the door body comprises ferrocement, thin-shell concrete or ferro-concrete, particularly reinforced mortar or plaster (lime or cement, sand and water) applied over layer of metal mesh, woven expanded-metal or metal-fibers and closely spaced thin steel rods such as rebar, wherein the metal used is iron or steel.

In another aspect, the door body comprises carbon fiber reinforced polymer, carbon fiber reinforced plastic, or carbon fiber reinforced thermoplastic (CFRP, CRP, CFRTP), or carbon fiber, carbon composite, or simple carbon.

In another aspect, the door body comprises fiberglass or glass-reinforced plastic (GRP), In another aspect, the door body is of a monocoque arrangement or structural skin, wherein the door body is of a single shell.

In another aspect, the door body is made by cold moulding or the strip-built method.

In another aspect, the door body is made by strip-plank epoxy planking.

In another aspect, the door body comprises tropical hardwood planks.

In another aspect, the door body comprises narrow, flexible strips of wood which are layered, wherein each layer is coated with resin, followed by another directionally alternating layer laid on top, wherein the subsequent layers are stapled and/or mechanically fastened to the previous, or weighted or vacuum bagged.

In another aspect, the door body comprises laminated thin strips of wood.

In another aspect, the door body is made by lofting, wherein long flexible strip of thin wood or thin plastic are bend, so that it passes over three non-linear points.

In another aspect, the door body is built by sandwiching thin fiber-reinforced skins.

In another aspect, the articulated parallelogram is embedded or housed within the door body and is not visible from outside the door body.

In another aspect, the articulated parallelogram is at least partially located outside the door body and/or visible from outside the door body.

In another aspect, the door-moving mechanism is located at the right rear end and/or left rear end of the gunwale.

In another aspect, a marine vessel comprises a door-moving mechanism according to the present invention.

Further disclosed is a marine vessel door system, the door system comprising:

a door; and a door-moving mechanism configured to displace the door to a leftmost position and a rightmost position; wherein the mechanism includes a first lever and second lever, each rotatably attached between a door mount and a boat mount at attachment points, where the levers pivot to allow the door to displace between the leftmost position and the rightmost position.

In another aspect, in the leftmost position the attachment points between the levers and the mounts form a parallelogram geometry in relation to one another.

In another aspect, in the rightmost position the attachment points between the levers and the mounts form a parallelogram geometry in relation to one another.

In another aspect, in a central position between the rightmost position and the leftmost position, the attachment points form a rectangular or square geometry in relation to one another.

In another aspect, the levers include an angle between two arms, where attachment points of the arms are at distal ends of the arms.

In another aspect, in a leftmost configuration, a right arm of a first lever is adjacent to and generally parallel to a right arm of a second lever, and in a rightmost configuration, a left arm of the first lever is adjacent to and generally parallel to a left arm of the second lever.

In another aspect, in an intermediate position, angles of the levers are adjacent one another.

In another aspect, in a leftmost and rightmost configuration, a left arm and right arm respectively become generally parallel to a boat deck.

In another aspect, the system acts as a hinge that provides an elliptical path of travel for the door.

In another aspect, each lever has one rotating attachment point to a fixed mount of the boat and a rotating attachment point to a displacing mount on the door, the attachment points being distally located on the arms of the levers, the attachment points on each mount being in-line with another attachment point on the same mount, and an attachment points line on one mount being generally parallel with an attachment point line on an opposite mount through motions of the door.

In another aspect, the attachment points have a geometric pattern in leftmost and rightmost positions resembling a parallelogram, and in an intermediate position, the attachment points forming a square or rectangular pattern.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
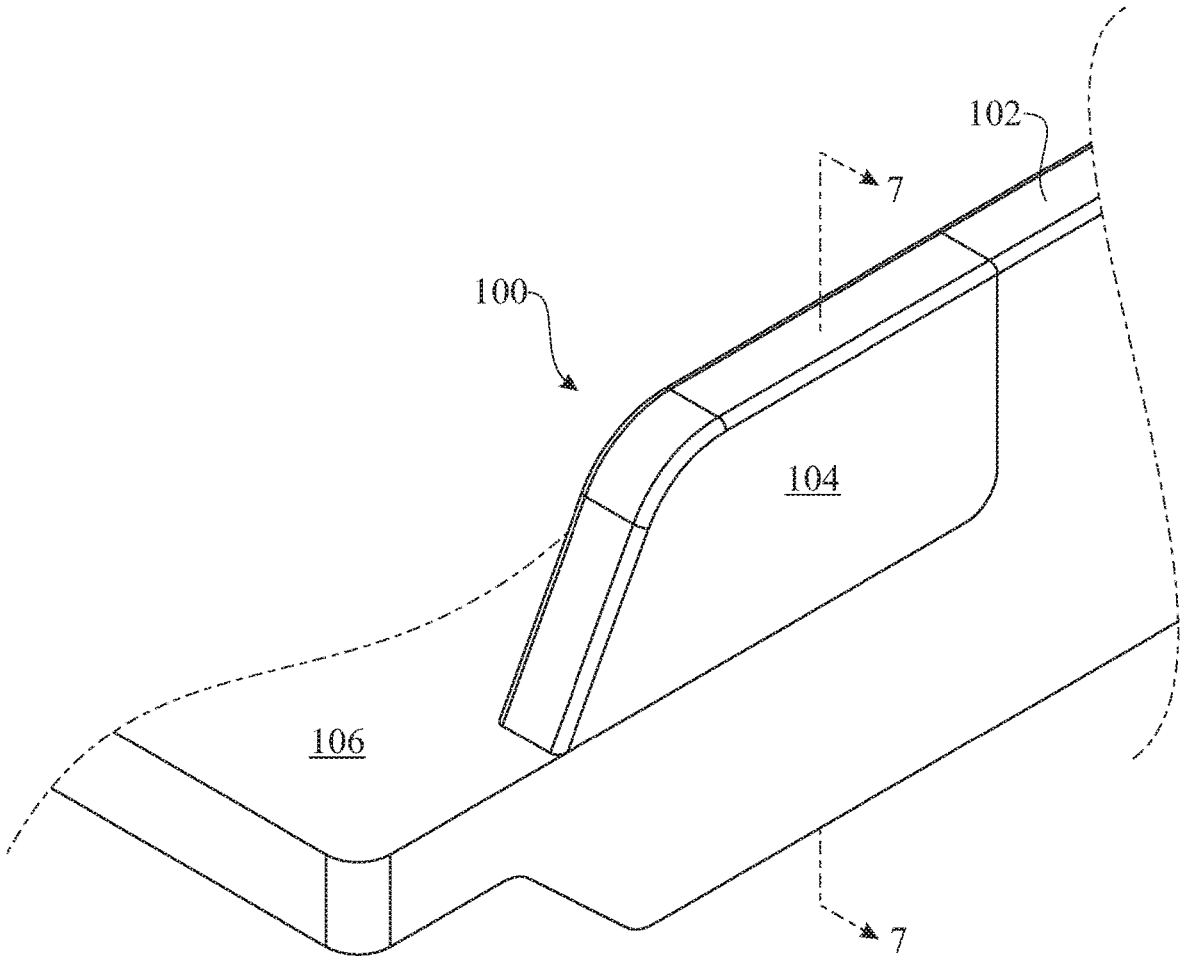
FIG. 1 presents a top perspective view of a marine vessel door system in a closed position, in accordance with aspects of the present disclosure.

The illustration of FIG. 1 shows a right side of a rear area of a boat. This area comprises a marine vessel deck 106 and the marine vessel gunwale 102 of the boat, wherein the gunwale 102 is mounted rectangular to the deck 106. A marine vessel door system 100 is arranged at the rear end of the gunwale 102. The marine vessel door system 100 comprises a door body 104, which is aligned with the gunwale 102 and rectangular to the deck 106. The door body 104 is a hollow door body 104 and is shaped like a right(-angled) trapezoid. The door body 104 is made of the same material as the gunwale 102. This material is carbon fiber reinforced polymer, carbon fiber reinforced plastic, or carbon fiber reinforced thermoplastic (CFRP, CRP, CFRTP). The door body 104 is of a monocoque arrangement or structural skin, wherein the door body 104 is of a single shell made by cold moulding or the strip-built method.

The door body 104 can also comprise narrow, flexible strips of wood which are layered, wherein each layer is coated with resin, followed by another directionally alternating layer laid on top, wherein the subsequent layers are stapled and/or mechanically fastened to the previous, or weighted or vacuum bagged.

Internally to the door body 104, the door system comprises a door-moving mechanism. The door-moving mechanism carries the door-body 104 and is configured to translate the door body 104 frontward and rearward relative to the marine vessel gunwale 102, in a direction of movement which is generally along the gunwale 102; i.e., the door-moving mechanism translates the door body 104 frontward and rearward along the gunwale 102. The door-moving mechanism is attached to deck 106 and concealed by the door body 104. The door body 104 can be made of a transparent material making the door-moving mechanism visible from outside the door body 104.

Figure 2:
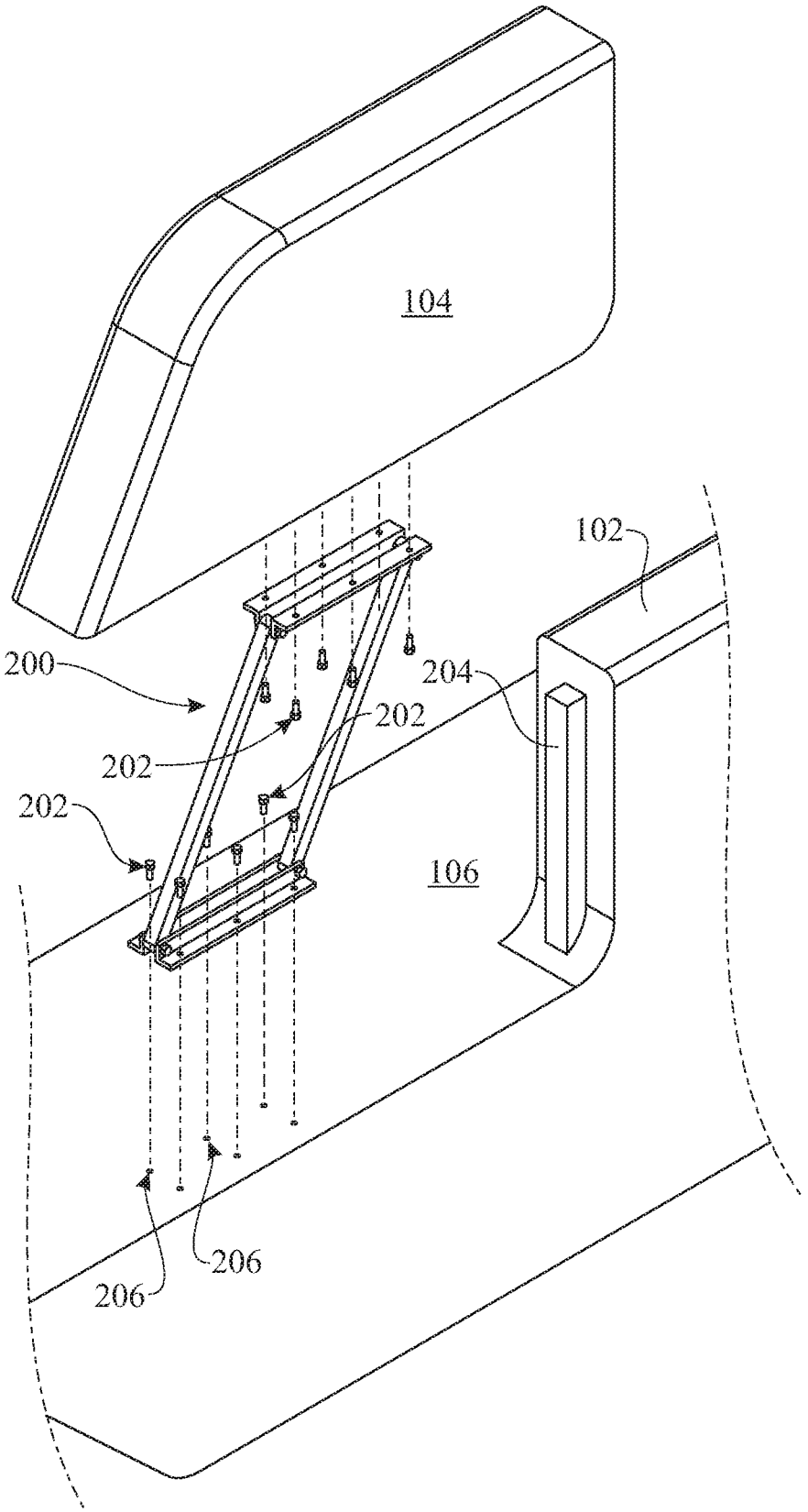
FIG. 2 presents an exploded view of the marine vessel door system of FIG. 1, in accordance with aspects of the present disclosure.

The illustration of FIG. 2 shows an exploded view of the marine vessel door system 100 of FIG. 1. The marine vessel door system 100 comprises besides the door body 104 the door-moving mechanism which is embodied as an articulated parallelogram 200. The deck 106 comprises at the location of the marine vessel door system 100 holes 206. The door body 104 also comprises holes (not shown) on its bottom surface. The articulated parallelogram 200 can be screwed to the holes 206 of the deck 106 and to the holes of the door body 104 by screws 202. The gunwale 102 comprises at its rear end a vertical bulge 204 which fits a vertical groove of the door body 104. The bulge 204 is shaped like an elongated cuboid. Once the door body 104 is closed the bulge 204 is placed inside the groove and the door body 104 is further stabilized against the gunwale 102.

Figure 3:
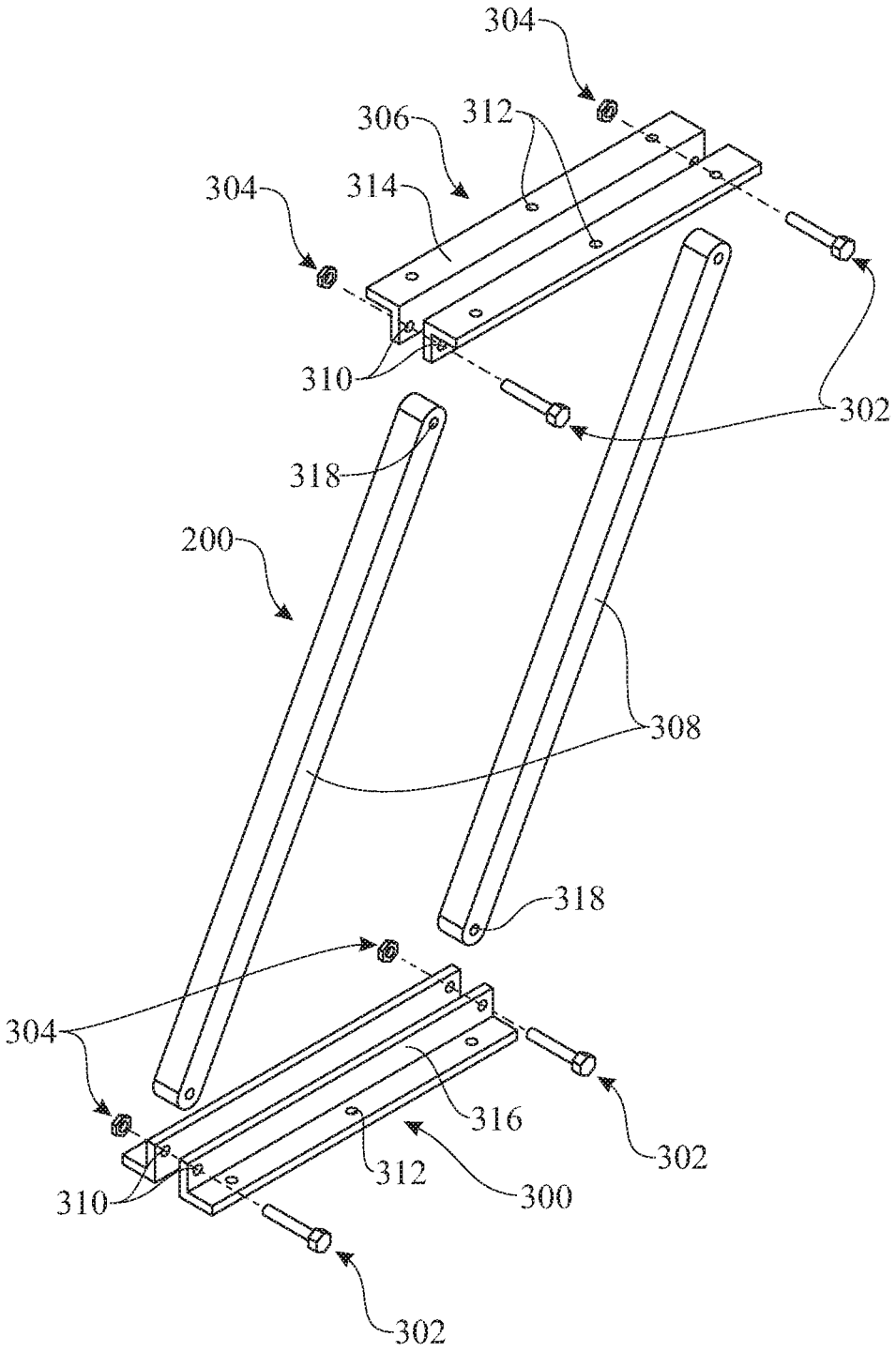
FIG. 3 presents an exploded view of the articulated parallelogram of the marine vessel door system of FIG. 2, in accordance with aspects of the present disclosure.

The illustration of FIG. 3 shows an exploded view of the articulated parallelogram 200 of the marine vessel door system of FIG. 2. The articulated parallelogram 200 comprises a longish or longitudinal bottom support 300 (structure) and a longish top support 306, wherein the bottom support 300 and the top support 306 are of the same length. The bottom and top support 300, 306 are made of stainless steel, or any other appropriate rigid and strong material. Each of the bottom and top support 300, 306 comprise an elongated flat plate 314 and a pair of upright parts 316, wherein the pair of upright parts 316 are mounted perpendicularly to the respective plate 314. The plates 314 of the bottom and top support 300, 306 comprise first holes 312 by which the bottom support 300 can be screwed to the deck 106 and the top support 306 can be screwed to the door body 104 to carry the door body 104 (see FIG. 2). Each of the pair of upright parts 316 of the bottom and top support 300, 306 comprise one pair of second holes 310 at their ends, wherein the pair of second holes 310 are positioned pairwise oppositely to each other at the end of each upright parts 316 of the bottom and top support 300, 306.

Two rods 308 made of stainless steel and of the same length, wherein each of the rods 308 are twice as long as the bottom and/or the top support, comprise third holes 318 at each of their ends. The third holes 318 are as big as the pair of second holes 310. The rods 308 are shaped like a cuboid.

When an end of a rod 308 is placed between a pair of second holes 310 a screw 302 can be pushed through the pair of second and third hole 310, 318 and screwed with a bolt 304. The screw 302 is designed in a manner that it only screws with the bolt 304 and not with the pair of second and/or third hole 310, 318. The pin 302 and the pair of second and third hole 310, 318 form a hinge in a manner that the rods 308 can be moved radial around the pins 302. When both rods 308 are connected to the bottom and top support 300, 306 by the pins 302 and the bolts 304 an articulated parallelogram 200 is established.

Figure 4:
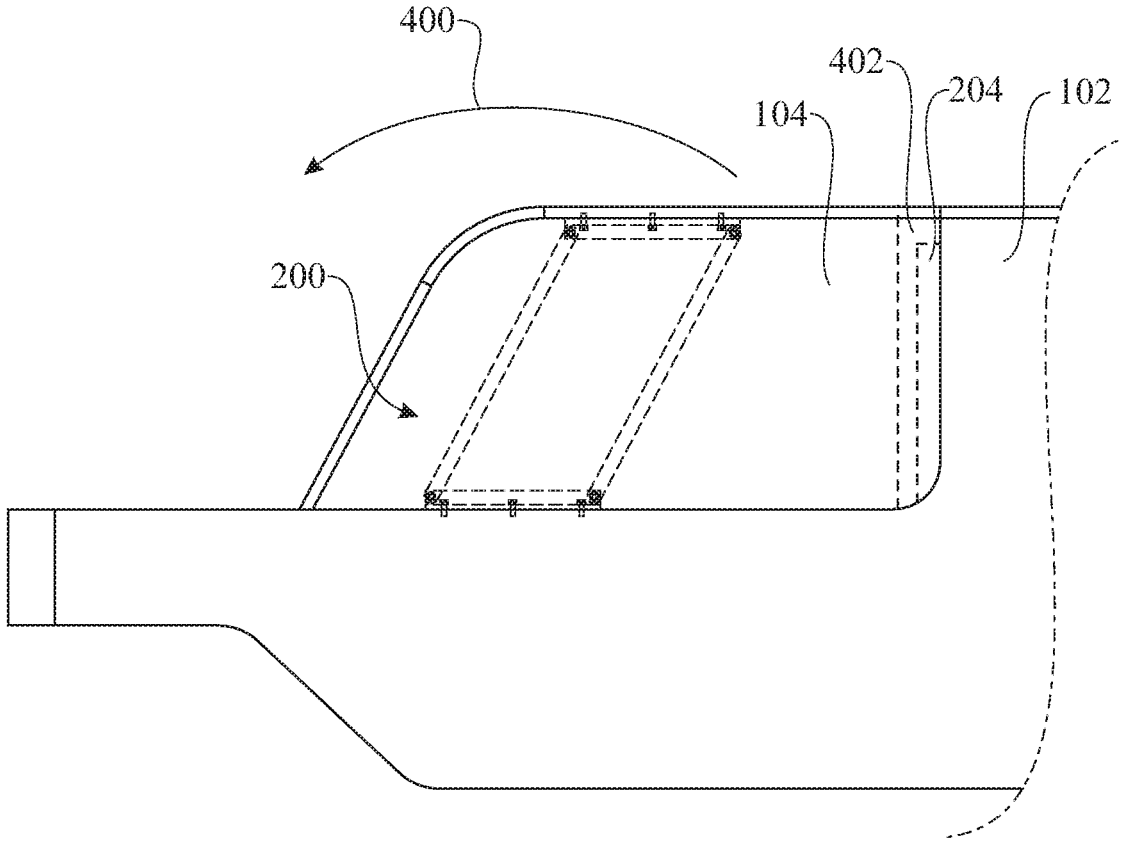
FIG. 4 presents a side view of the marine vessel door system of FIG. 1, in accordance with aspects of the present disclosure, where internal parts are shown via dashed line.

The illustration of FIG. 4 shows a crossectional view of the marine vessel door system 100 according cross-sectional plane 4-4 of FIG. 1. The door body 104 is in a closed position. In this position the bulge 204 of the gunwale 102 is placed inside the vertical groove 402 of the door body 104 to further stabilize the door body 104 against the gunwale 102. The groove is shaped like a hollow cuboid to fit the bulge 204 of the gunwale 102 (see FIG. 2). The angles inside the articulated parallelogram 200 are pairwise acute and obtuse, wherein the acute angles are arranged opposite to each other and the obtuse angles are arranged opposite to each other. The sum of all four angles is equal to 360°. The door body 104 of the marine vessel door system 100 can be opened in the direction of the arrow 400.

Figure 5:
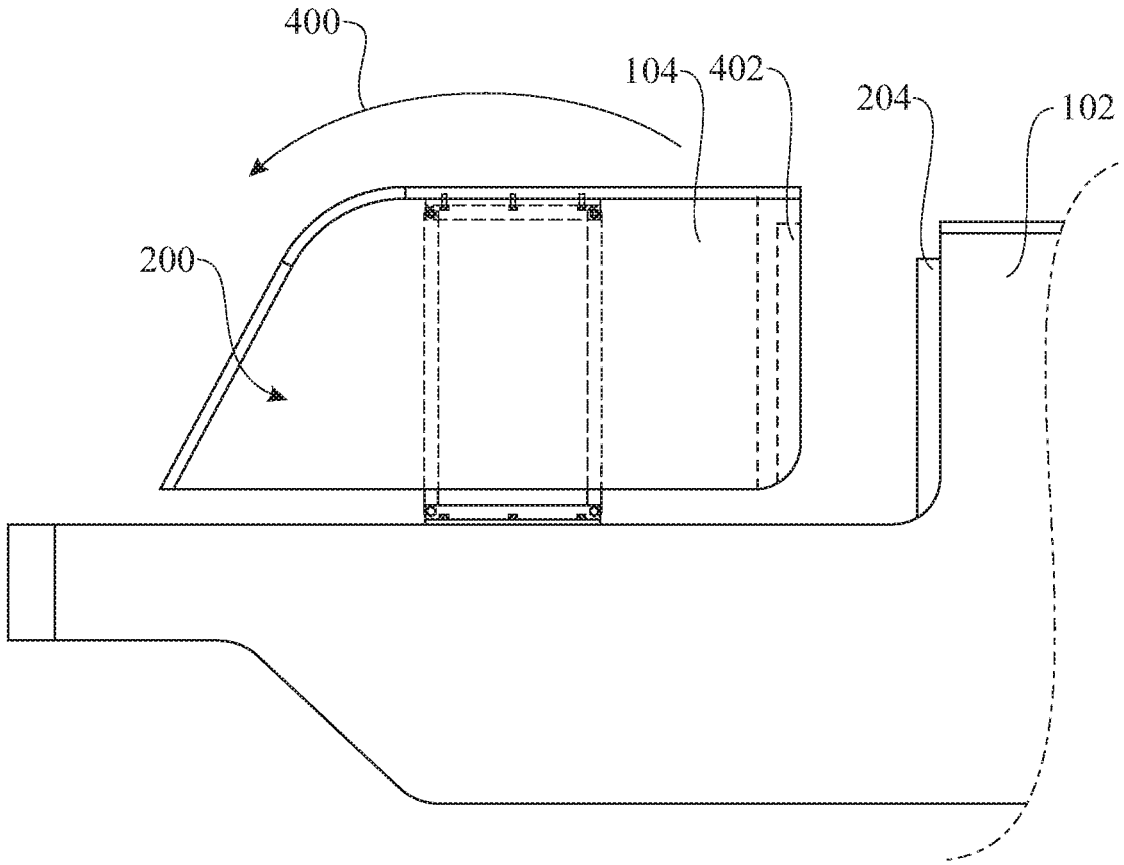
FIG. 5 presents a side view of the marine vessel door system of FIG. 4 in a position between the open and closed position, in accordance with aspects of the present disclosure, where internal parts are shown via dashed line.

The illustration of FIG. 5 shows a crossectional view of the marine vessel door system of FIG. 4 in a position between the open and closed position. The door body 104 has been moved in the direction of the arrow 400 from a closed position of FIG. 4 to the position depicted in FIG. 5. All four angles of the articulated parallelogram 200 are rectangular and the sum of all four angles is still equal to 360°. The door body 104 is located at a height of the deck 106. The bulge 204 is outside of the groove 402.

It is to be understood that the groove 402 and the bulge 204 may be configured to snap together or lock. For example, the bulge 204 or groove 402 may include an angled projection that allows the parts the snap together. Other locking mechanisms may be included, such as a locking mechanism for the door moving mechanism 200. It is anticipated that rust-resistant motors and corresponding switches may be included.

Figure 6:
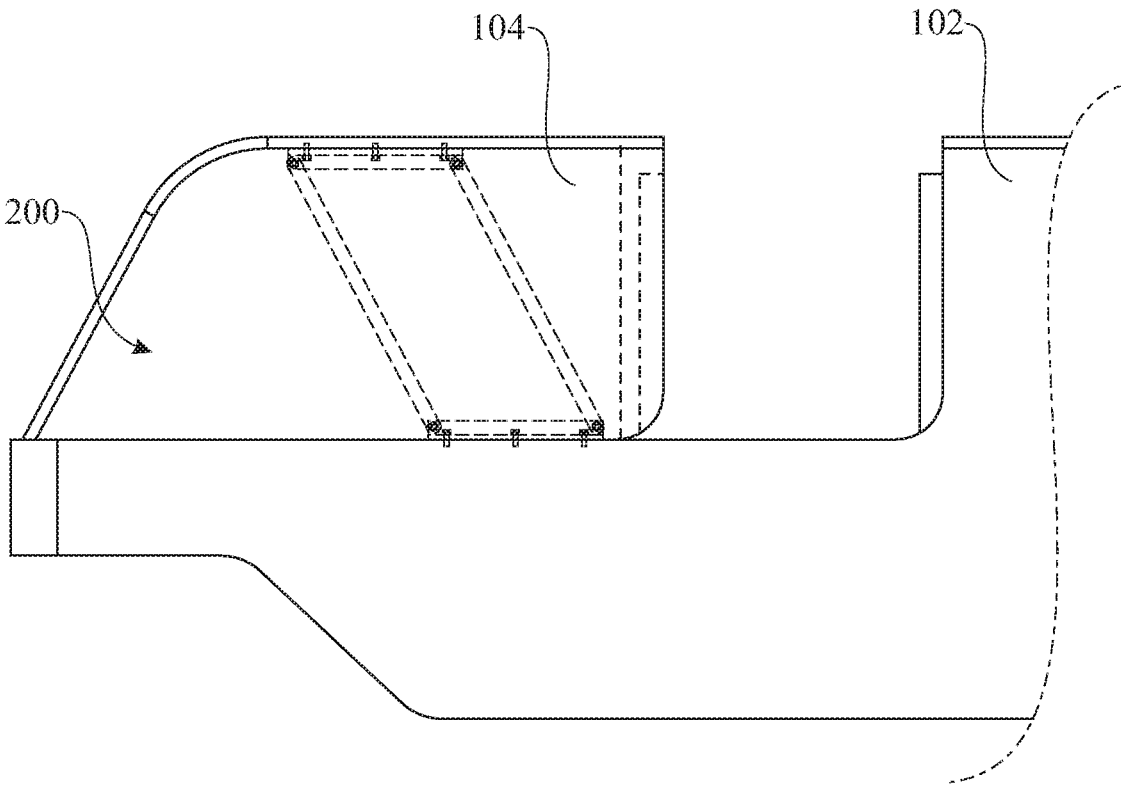
FIG. 6 presents a side view of the marine vessel door system of FIG. 4 in an open position, in accordance with aspects of the present disclosure, where internal parts are shown via dashed line.
Figure 7:
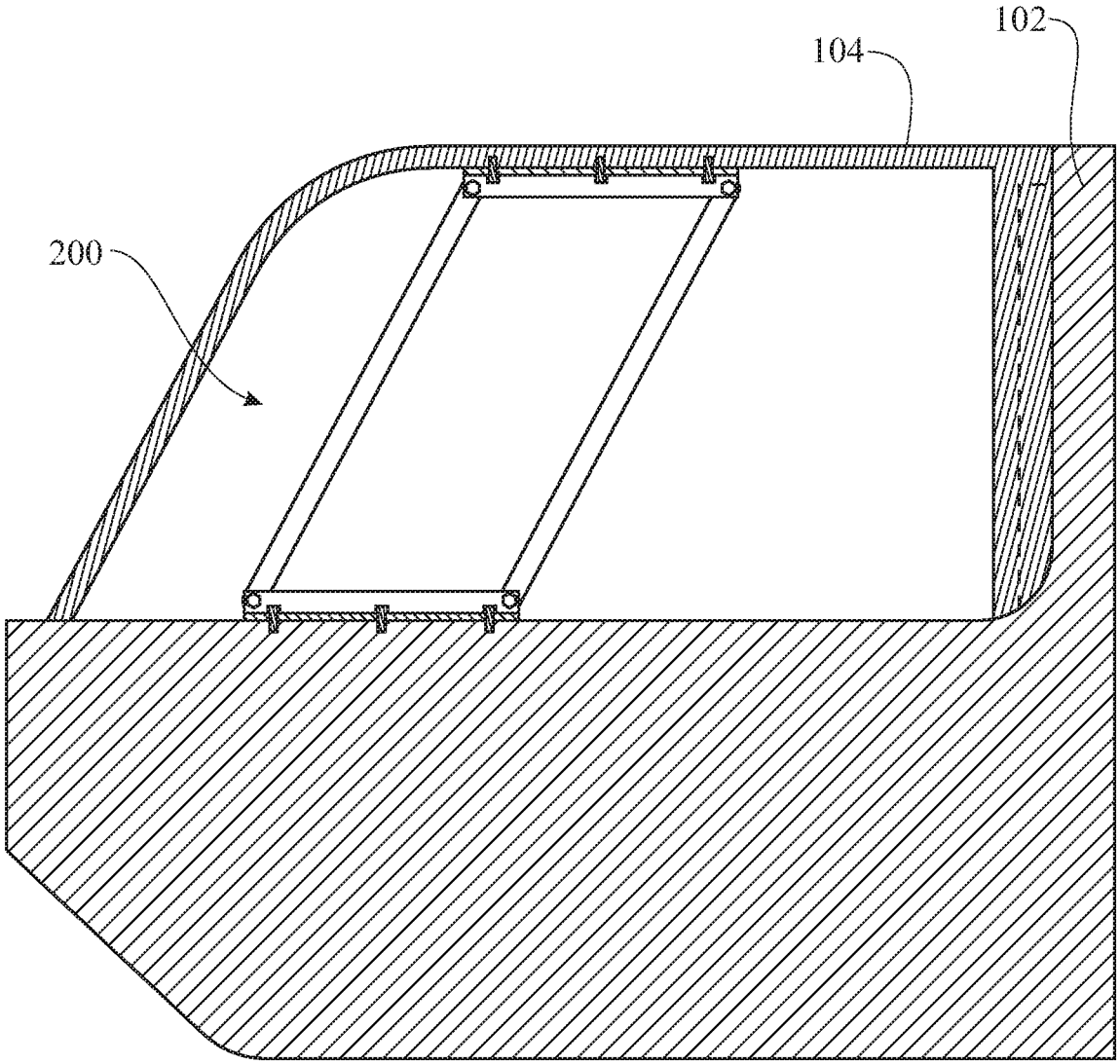
FIG. 7 presents a cross sectional view of the marine vessel door system of FIG. 4, where the cross section is taken along plane 7-7 shown in FIG. 1, in accordance with aspects of the present disclosure.
Figure 8:
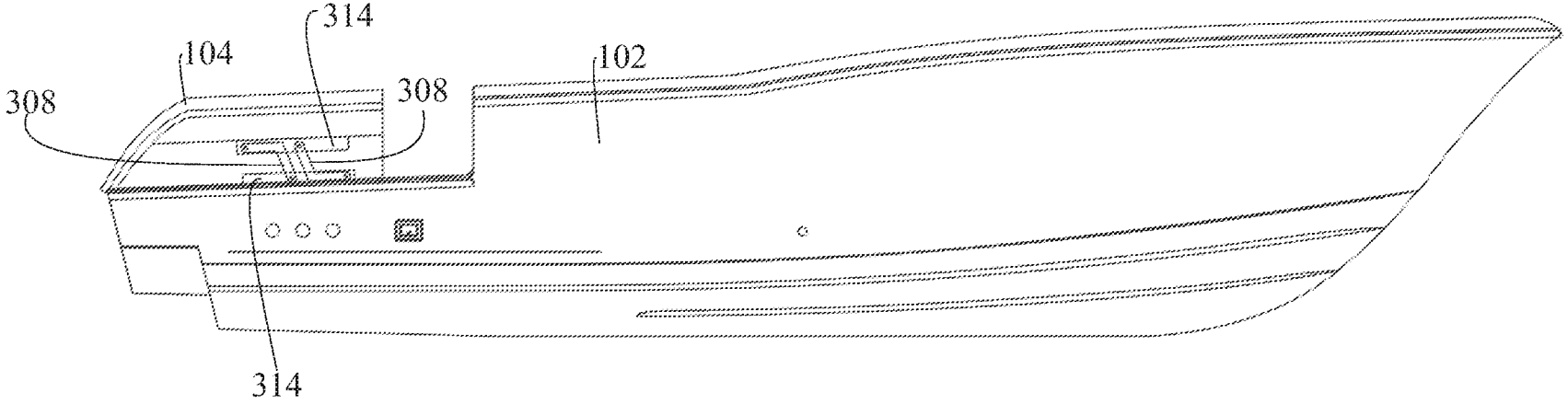
FIG. 8 presents a side view of another configuration of a marine vessel door system, in accordance with aspects of the present disclosure.
Figure 9:
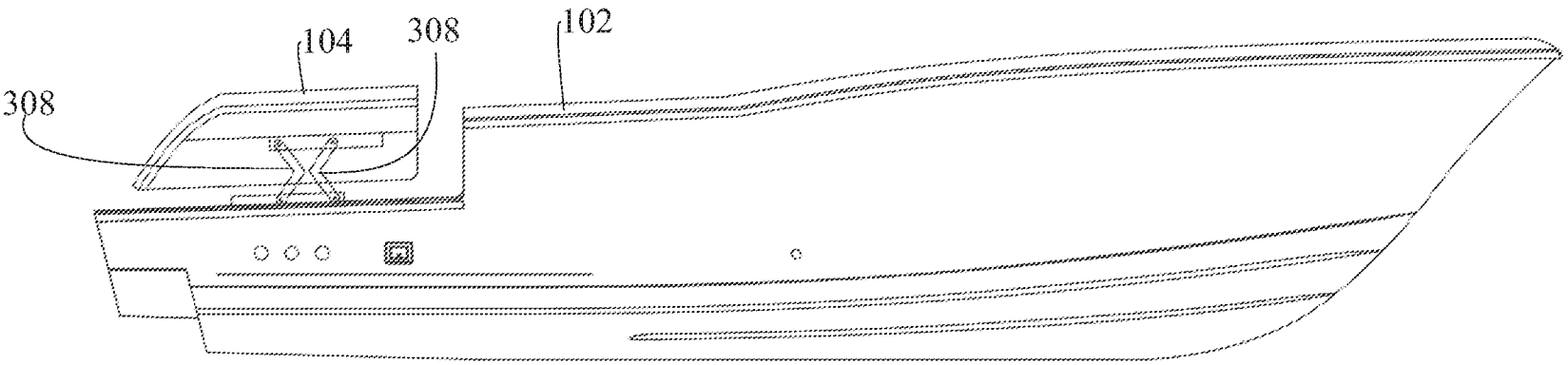
FIG. 9 presents the system of FIG. 8, where the door has been displaced midway between a leftmost position and a rightmost position.
Figure 10:
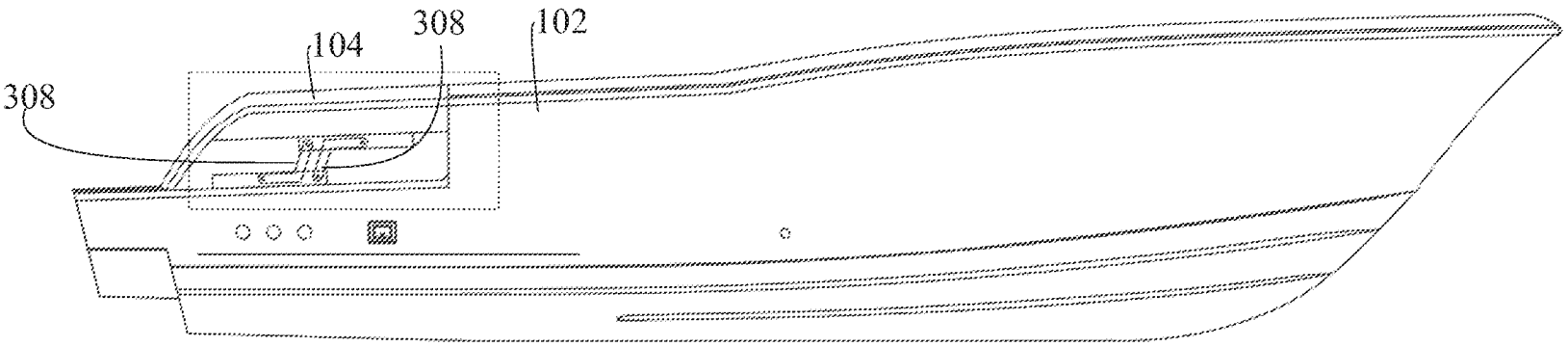
FIG. 10 presents the system of FIG. 8, where the door has been displaced completely to an opposite position, in accordance with aspects of the present disclosure.

The illustration of FIG. 6 shows a crossectional view of the marine vessel door system 100 of FIG. 4 in an open position. The acute angles of articulated parallelogram 200 in FIG. 4 are now obtuse and vice versa. The sum of all four angles is still equal to 360°. The door body 104 touches the deck 106 and is located closer to the stern of the boat compared to the closed position.

In conclusion the illustrations of FIG. 4-6 show a movement of the door system 100 from a closed position to an open position. The articulated parallelogram 200 is dimensioned in manner that opposite angles of the parallelogram 200 stay the same during a movement of the top support 306 relative to the bottom support 300. The articulated parallelogram 200 is dimensioned in a manner such that that the sum of all four angles of the parallelogram stays at 360° during a movement of the top support 306 relative to the bottom support 300. Furthermore, the articulated parallelogram 200 is dimensioned in a manner that a sum of angles next to each other in the parallelogram 200 stays at 180° during a movement of the top support 306 relative to the bottom support 300.

Figure 11A:
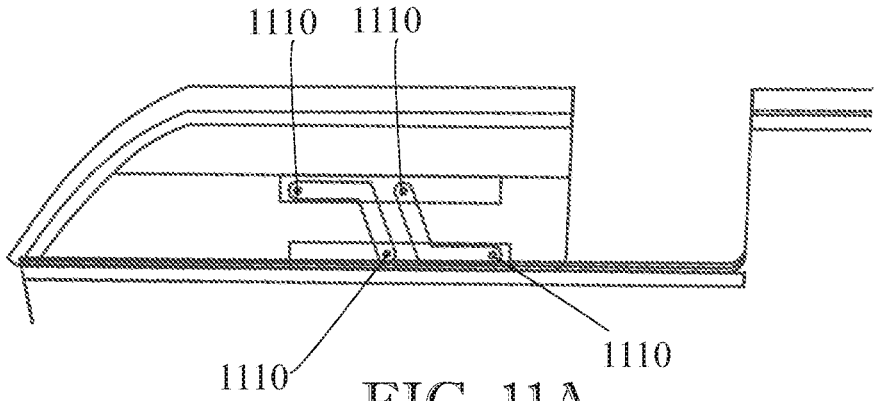
FIGS. 11A-C present close up views of the system of FIG. 8, in three different configurations in sequence, in accordance with aspects of the present disclosure.
Figure 11B:
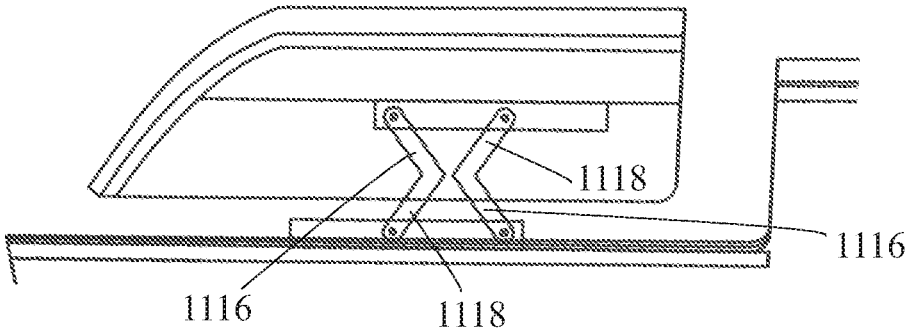
Figure 11C:
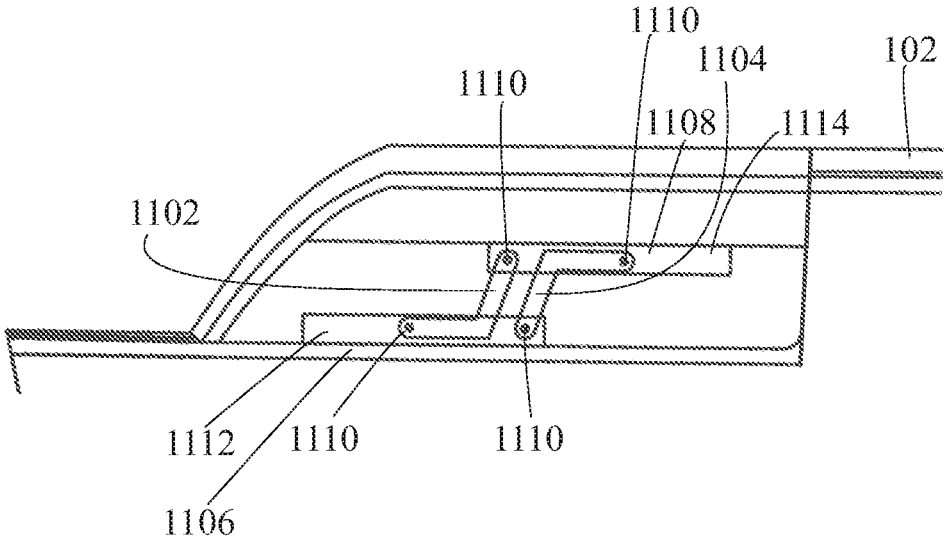

The illustrations of FIGS. 8-11C show another variation of the system. For example, FIGS. 11A-11C show a close up view of the system. The system includes a first lever 1102 and a second lever 1104 (FIG. 11C). The levers each have an angle exactly or generally at their midpoints. The levers each are rotatably attached to a fixed boat mount 1106 and a door mount 1108. The door mount 1108 is fixed to the door and slides together with the door. The boat mount 1106 is fixed to the boat and does not move with respect to the boat.

The angle is at a midpoint and defines two arms, left arm 1116 and right arm 1118 (FIG. 11B) shown in FIG. 11B. The angle could be any appropriate angle to provide the functionality described herein, such as a right angle or an angle less than or greater than 90 degrees.

Turning to FIG. 11A, the system is in its leftmost configuration. In FIG. 11B the system is in an intermediate position, and in FIG. 11C the system is in a rightmost position. In sequence it is shown that the system allows the door to translate or displace from right to left and left to right via the levers.

In the leftmost configuration, a right arm of a first lever is adjacent to and generally parallel to a right arm of the second lever. In the rightmost configuration, the left arm of the first lever is adjacent to and generally parallel to a left arm of the second lever. In the intermediate position, the angles of the levers are adjacent one another and a general "X" shape may be formed by the levers, and where vertices of the angles are pointed toward one another. In the leftmost and rightmost configuration, the left arm and right arm respectively become parallel to generally the surface of the boat and the respective mount 1112 or 1114.

The system creates a hinge that provides an elliptical path of travel for the door. In other words, vertical displacement is less than horizontal displacement. All of the above mentioned features, elements, structures, functions, and methods of FIGS. 1-7 also apply to the embodiments shown in FIGS. 8-11C without departing from the spirit and scope of the disclosure.

Each lever has one rotating connection 1110 to a fixed mount 1106 of the boat 102 and a rotating connection to a displacing mount 1108 on the door. These connection points are distally located on the arms of the levers. The connection points on each mount (e.g. door or boat) are in line with another connection point on the same mount, and the connection points (line) on one mount (e.g. boat) are generally parallel with connection points (line) on an opposite mount (e.g. door). The connection points have a geometric pattern in the leftmost and rightmost positions resembling a parallelogram, and in the intermediate position, these connection points form a square or rectangular pattern. These patterns can be seen in FIGS. 11A-11C from a side view.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A marine vessel door system, the door system comprising:

a door; and a door-moving mechanism configured to displace the door to a leftmost position and a rightmost position; and wherein the mechanism includes a first lever and second lever, each rotatably attached between a door mount and a boat mount at attachment points, where the levers pivot to allow the door to displace between the leftmost position and the rightmost position; and wherein in a leftmost and rightmost configuration, a left arm and right arm respectively become generally parallel to a boat deck.

2. The system of claim 1, wherein in the leftmost position the attachment points between the levers and the mounts form a parallelogram geometry in relation to one another.

3. The system of claim 1, wherein in the rightmost position the attachment points between the levers and the mounts form a parallelogram geometry in relation to one another.

4. The system of claim 1, wherein in a central position between the rightmost position and the leftmost position, the attachment points form a rectangular or square geometry in relation to one another.

5. The system of claim 1, wherein the levers include an angle between two arms, where attachment points of the arms are at distal ends of the arms.

6. The system of claim 1, wherein in a leftmost configuration, a right arm of a first lever is adjacent to and generally parallel to a right arm of a second lever, and in a rightmost configuration, a left arm of the first lever is adjacent to and generally parallel to a left arm of the second lever.

7. The system of claim 1, wherein in an intermediate position, angles of the levers are adjacent one another.

8. The system of claim 1, wherein the attachment points have a geometric pattern in leftmost and rightmost positions resembling a parallelogram, and in an intermediate position, the attachment points forming a square or rectangular pattern.

9. A marine vessel door system, the door system comprising:

a door; and a door-moving mechanism configured to displace the door to a leftmost position and a rightmost position; and wherein the mechanism includes a first lever and second lever, each rotatably attached between a door mount and a boat mount at attachment points, where the levers pivot to allow the door to displace between the leftmost position and the rightmost position; and wherein the system acts as a hinge that provides an elliptical path of travel for the door.

10. A marine vessel door system, the door system comprising:

a door; and a door-moving mechanism configured to displace the door to a leftmost position and a rightmost position; and wherein the mechanism includes a first lever and second lever, each rotatably attached between a door mount and a boat mount at attachment points, where the levers pivot to allow the door to displace between the leftmost position and the rightmost position; and wherein each lever has one rotating attachment point to a fixed mount of the boat and a rotating attachment point to a displacing mount on the door, the attachment points being distally located on the arms of the levers, the attachment points on each mount being in-line with another attachment point on the same mount, and an attachment points line on one mount being generally parallel with an attachment point line on an opposite mount through motions of the door.

11. A marine vessel door system, the door system comprising:

a door; and a door-moving mechanism configured to displace the door to a leftmost position and a rightmost position;

wherein the mechanism includes a first lever and second lever, each rotatably attached between a door mount and a boat mount at attachment points, where the levers pivot to allow the door to displace between the leftmost position and the rightmost position;

wherein in the leftmost position the attachment points between the levers and the mounts form a parallelogram geometry in relation to one another;

wherein in the rightmost position the attachment points between the levers and the mounts form a parallelogram geometry in relation to one another; and wherein in a leftmost and rightmost configuration, a left arm and right arm respectively become generally parallel to a boat deck.

12. The system of claim 11, wherein in a central position between the rightmost position and the leftmost position, the attachment points form a rectangular or square geometry in relation to one another.

13. The system of claim 11, wherein the levers include an angle between two arms, where attachment points of the arms are at distal ends of the arms.

14. The system of claim 11, wherein in a leftmost configuration, a right arm of a first lever is adjacent to and generally parallel to a right arm of a second lever, and in a rightmost configuration, a left arm of the first lever is adjacent to and generally parallel to a left arm of the second lever.

15. The system of claim 11, wherein in an intermediate position, angles of the levers are adjacent one another.

16. A marine vessel door system, the door system comprising:

a door; and a door-moving mechanism configured to displace the door to a leftmost position and a rightmost position;

wherein the mechanism includes a first lever and second lever, each rotatably attached between a door mount and a boat mount at attachment points, where the levers pivot to allow the door to displace between the leftmost position and the rightmost position;

wherein in the leftmost position the attachment points between the levers and the mounts form a parallelogram geometry in relation to one another; and wherein in the rightmost position the attachment points between the levers and the mounts form a parallelogram geometry in relation to one another; and wherein the system acts as a hinge that provides an elliptical path of travel for the door.

* * * * *